US009987726B2

(12) United States Patent
Olsen

(10) Patent No.: US 9,987,726 B2
(45) Date of Patent: Jun. 5, 2018

(54) PARTICULATE REINFORCED BRAZE ALLOYS FOR DRILL BITS

(71) Applicant: Halliburton Energy Services, Inc., Houston, TX (US)

(72) Inventor: Garrett T. Olsen, The Woodlands, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 54 days.

(21) Appl. No.: 15/022,300

(22) PCT Filed: Oct. 17, 2013

(86) PCT No.: PCT/US2013/065382
§ 371 (c)(1),
(2) Date: Mar. 16, 2016

(87) PCT Pub. No.: WO2015/057225
PCT Pub. Date: Apr. 23, 2015

(65) Prior Publication Data

US 2016/0221151 A1 Aug. 4, 2016

(51) Int. Cl.

| | |
|---|---|
| ***E21B 10/62*** | (2006.01) |
| ***E21B 10/627*** | (2006.01) |
| ***E21B 10/633*** | (2006.01) |
| ***B23K 35/32*** | (2006.01) |
| ***B24D 3/00*** | (2006.01) |
| ***E21B 10/573*** | (2006.01) |
| ***E21B 10/54*** | (2006.01) |
| ***E21B 10/567*** | (2006.01) |
| ***E21B 10/42*** | (2006.01) |

(52) U.S. Cl.
CPC ..... *B24D 3/007* (2013.01); *E21B 10/42* (2013.01); *E21B 10/54* (2013.01); *E21B 10/567* (2013.01); *E21B 10/573* (2013.01)

(58) Field of Classification Search
CPC ..... E21B 10/62; E21B 10/627; E21B 10/633; B23K 35/327
See application file for complete search history.

(56) References Cited

U.S. PATENT DOCUMENTS

| | | | |
|---|---|---|---|
| 4,049,434 | A | 9/1977 | Sloboda et al. |
| 7,303,030 | B2 | 12/2007 | Lockwood et al. |
| 7,666,244 | B2 | 2/2010 | Lockwood et al. |

(Continued)

FOREIGN PATENT DOCUMENTS

| | | | |
|---|---|---|---|
| EP | 1318268 | B1 | 1/2006 |
| EP | 1922428 | A1 | 5/2008 |

(Continued)

OTHER PUBLICATIONS

Chinese Office Action, Application No. 2013800790691, with English translation, 19 pages, dated Nov. 22, 2016.

(Continued)

*Primary Examiner* — Cathleen R Hutchins
(74) *Attorney, Agent, or Firm* — Baker Botts L.L.P.

(57) ABSTRACT

An example drill bit for subterranean drilling operations includes a drill bit body with a blade. The drill bit may further include a cutting element and an alloy affixing the cutting element to the blade. The alloy may include a particulate phase, such as ceramic material or an intermetallic material, that increases the strength of the alloy without significantly affecting the melting point of the alloy.

18 Claims, 3 Drawing Sheets

(56) References Cited

U.S. PATENT DOCUMENTS

| | | | | |
|---|---|---|---|---|
| 8,309,018 | B2 | 11/2012 | Smith et al. | |
| 2005/0109545 | A1* | 5/2005 | Lockwood | B23K 9/04 175/374 |
| 2008/0029310 | A1 | 2/2008 | Stevens et al. | |
| 2010/0009089 | A1 | 1/2010 | Junod et al. | |

FOREIGN PATENT DOCUMENTS

| | | | |
|---|---|---|---|
| EP | 1944461 | A1 | 7/2008 |
| WO | 2007/030707 | | 3/2007 |
| WO | 2008/042330 | | 4/2008 |
| WO | 2011/073075 | | 6/2011 |

OTHER PUBLICATIONS

Canadian Office Action, Application No. No. 2,924,550, 3 pages, dated Feb. 8, 2017.
Chinese Office Action, Application No. 2013800790691, 3 pages, dated Aug. 15, 2017.
International Search Report and Written Opinion, Application No. PCT/US2013/065382, 18 pages, dated Jul. 4, 2014.
International Preliminary Report on Patentability, Application No. PCT/US2013/065382, 16 pages, dated Oct. 1, 2015.
Hong et al., "Tribological properties of copper alloy-based composites reinforced with tungsten carbide particles," Wear 270, pp. 591-597, 2011, http://home.kookmin.ac.kr/~heeman/paper/tribological.pdf. 2011.

* cited by examiner

PARTICULATE REINFORCED BRAZE ALLOYS FOR DRILL BITS

RELATED APPLICATIONS

This application is a U.S. National Stage Application of International Application No. PCT/US2013/065382 filed Oct. 17, 2013, which designates the United States, and which is incorporated herein by reference in its entirety.

BACKGROUND

The present disclosure relates generally to well drilling operations and, more particularly, to particulate reinforced braze alloys for drill bits.

Hydrocarbon recovery drilling operations typically require boreholes that extend hundred and thousands of meters into the earth. The drilling operations themselves can be complex, time-consuming and expensive and expose the drilling equipment, including drill bits, to high pressure and temperatures. The high pressures and temperatures degrade the drilling equipment over time. Fixed cutter drill bits, for example, may include polycrystalline diamond compact (PDC) cutters that are bonded to a drill bit body during production. The high pressures and temperatures experienced downhole may degrade the bonds, causing the some of the PDC cutters to detach from the drill bit, reducing the effectiveness of the drill bit and requiring it to be removed to the surfaces for replacement.

FIGURES

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to particulate reinforced braze alloys for drill bits.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Figure 1:
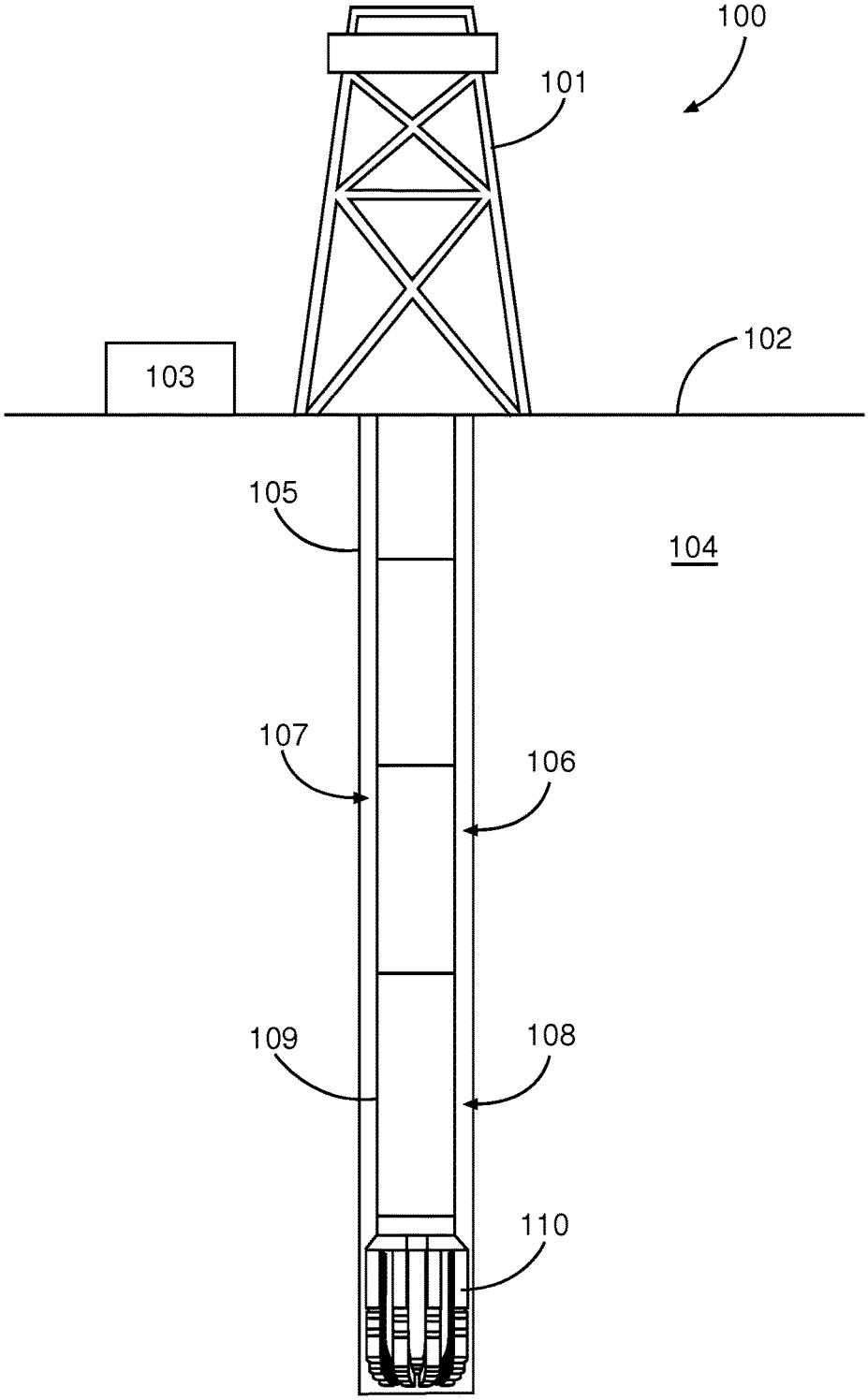
FIG. 1 is a diagram illustrating an example drilling system, according to aspects of the present disclosure.

FIG. 1 shows an example drilling system 100, according to aspects of the present disclosure. The drilling system 100 includes rig 101 mounted at the surface 102 and positioned above borehole 105 within a subterranean formation 104. In certain embodiments, the surface 102 may comprise a rig platform for off-shore drilling applications, and the subterranean formation 104 may be a sea bed that is separated from the surface 102 by a volume of water. In the embodiment shown, a drilling assembly 106 may be positioned within the borehole 105 and coupled to the rig 101. The drilling assembly 106 may comprise drill string 107 and bottom hole assembly (BHA) 108. The drill string 107 may comprise a plurality of drill pipe segments connected with threaded joints. The BHA 108 may comprise a drill bit 110, a measurement-while-drilling (MWD)/logging-while-drilling (LWD) section 109. The MWD/LWD section 109 may include a plurality of sensors and electronics used to measure and survey the formation 104 and borehole 105. In certain embodiments, the BHA 108 may include other sections, including power systems, telemetry systems, and steering systems. The drill bit 110 may be a roller-cone drill bit, a fixed cutter drill bit, or another drill bit type that would be appreciated by one of ordinary skill in the art in view of this disclosure. Although drill bit 110 is shown coupled to a conventional drilling assembly 106, other drilling assemblies are possible, including wireline or slickline drilling assemblies.

Figure 2:
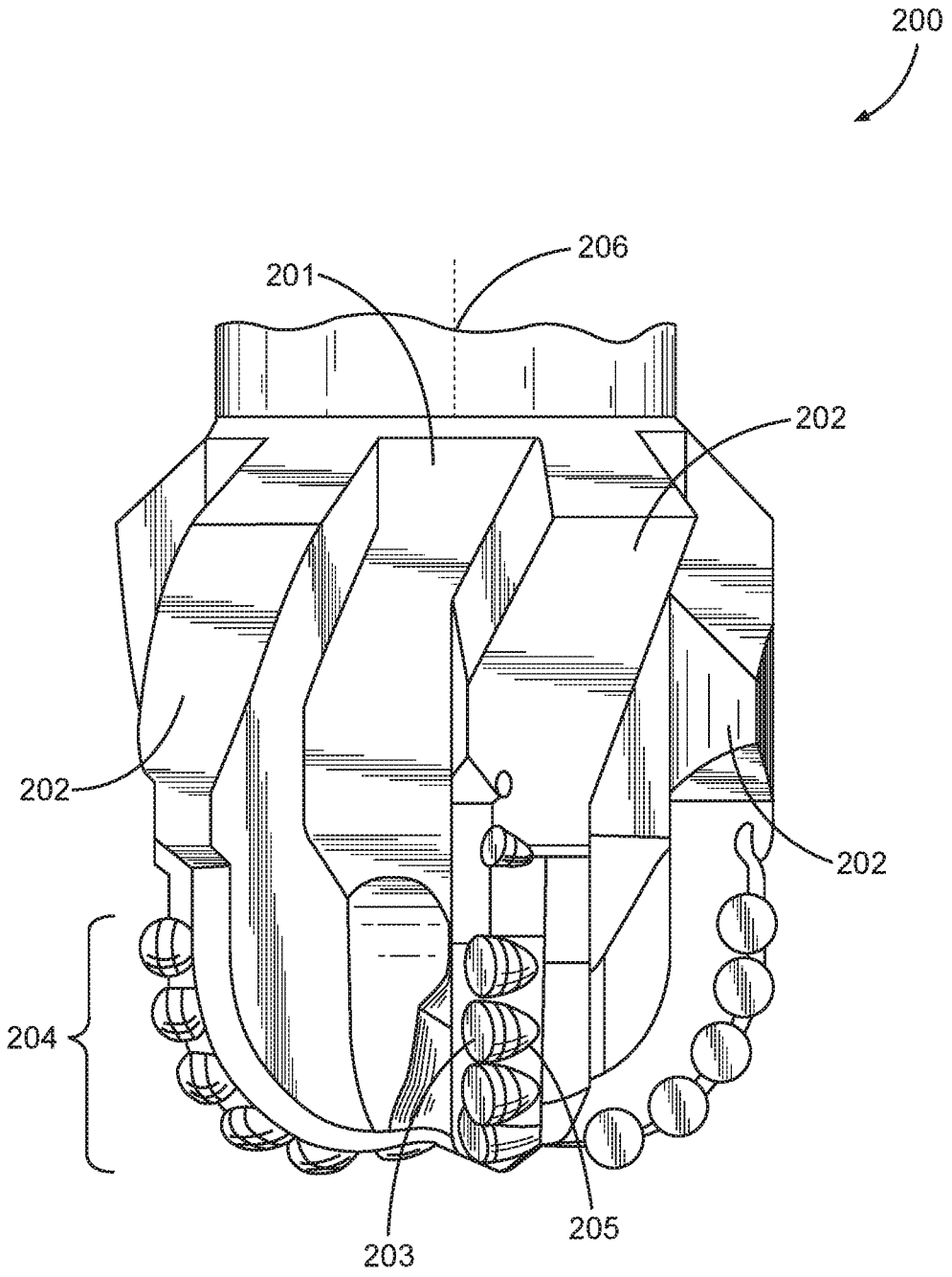
FIG. 2 is a diagram illustrating an example fixed cutter drill bit, according to aspects of the present disclosure.

FIG. 2 illustrates an example drill bit 200 for subterranean drilling operations, according to aspects of the present disclosure. In the embodiment shown, the drill bit 200 comprises a fixed cutter drill bit. The drill bit 200 comprises a drill bit body 201 with at least one blade 202. The drill bit body 201 may be manufactured out of steel, for example, or out of a metal matrix around a steel blank core. The blades 202 may be integral with the drill bit body 201, or may be formed separately and attached to the drill bit body 201. Additionally, the number of blades 202 and the orientation of the blades 202 relative to the drill bit body 201 may be varied according to design parameters that would be appreciated by one of ordinary skill in the art in view of this disclosure.

A cutting element 203 may be affixed to the at least one blade 202. In certain embodiments, at least one pocket 205 may be present on one of the blades 202, and the cutting element 203 may be at least partially disposed within the pocket 205. As will be described in detail below, a pocket 205 may comprise a notched or recessed area on an outer surface of a blade 202. In the embodiment shown, each of the blades 202 may comprise a plurality of pockets spaced along a cutting structure 204 of the drill bit 200. The cutting structure 204 of the drill bit 200 may comprise the portion of the drill bit 200 that removes rock from a formation during a drilling operation. The pocket 205 may be formed during the manufacturing process that forms the blades 202 or may be machined later. Like the number and orientation of the blades 202, the number and orientation of pockets 205 and cutting elements 203 on the blades 202 may be altered according to design parameters that would be appreciated by one of ordinary skill in the art in view of this disclosure.

The cutting element 203 may include a cutting surface that contacts rock in a formation and removes it as the drill bit 200 rotates. The cutting surface may be at least partly made of diamond. For example, the cutting surfaces may be partly made of synthetic diamond powder, such as polycrystalline diamond or thermally stable polycrystalline diamond; natural diamonds; or synthetic diamonds impregnated in a bond. In certain embodiments, the cutting element 203 may comprise a PDC cutter with a diamond layer attached to a substrate, as will be described below. The cutters 203 may extend outward in a radial direction from a longitudinal axis 206 of the drill bit 200, positioned along the blades 202.

Figure 3A:
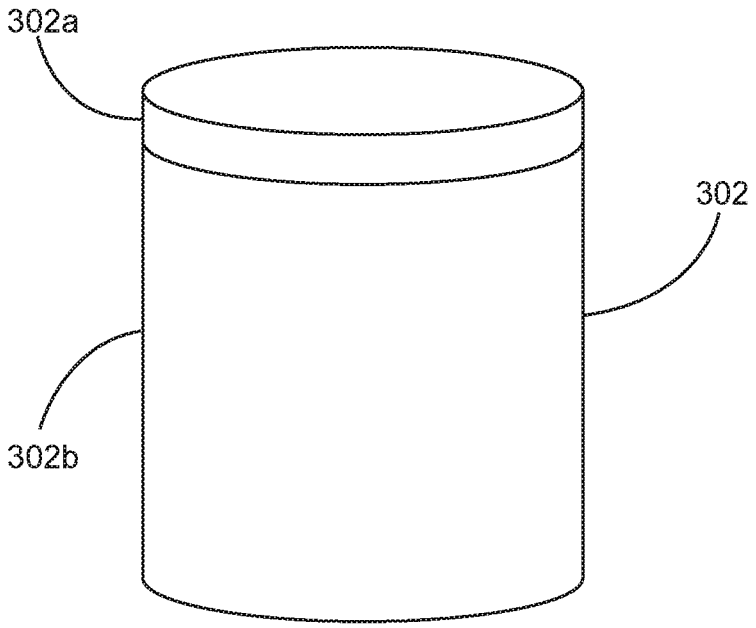
FIGS. 3A and 3B are diagrams illustrating an example PDC cutter bonded to a drill bit, according to aspects of the present disclosure.
Figure 3B:
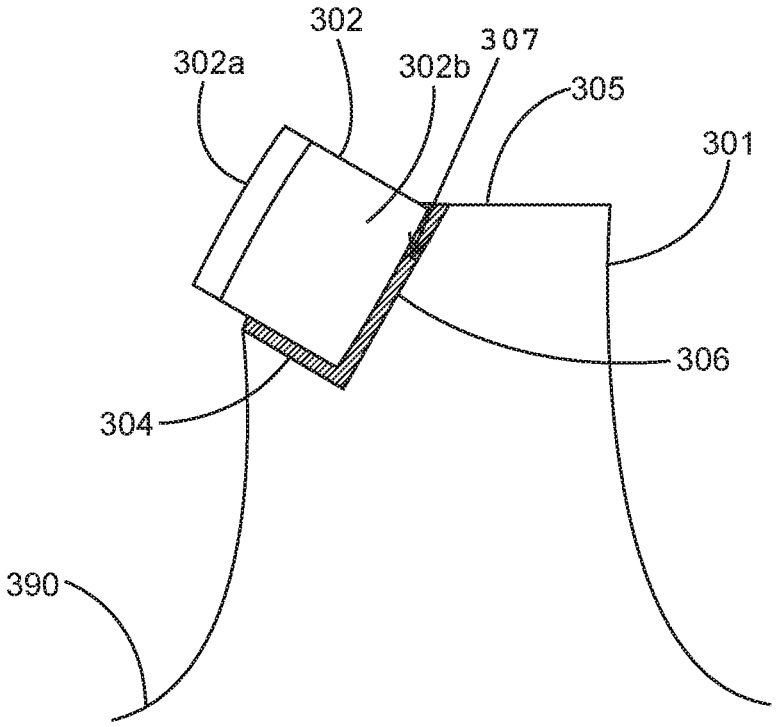

FIGS. 3A and 3B are diagrams illustrating an example cutting element 302 bonded to a drill bit 300, according to aspects of the present disclosure. The cutting element 302 comprises a PDC cutter with a polycrystalline diamond layer 302*a* coupled to a cylindrical substrate 302*b*. The substrate 302*b* may comprise a tungsten carbide substrate that is sintered with the polycrystalline diamond layer 302*a*. The sintering may take place within a high-pressure, high-temperature press that aides in the formation of the polycrystalline diamond layer 302*a* using diamond powder. The substrate 302*b* may be cylindrical and may have integral attachment surfaces at the interface between the substrate 302*b* and the polycrystalline diamond layer 302*a*. Additionally, although the PDC cutter 302 is cylindrical, other shapes and sizes are possible, as are other orientations of the polycrystalline diamond layer 302*a* relative to the substrate, as would be appreciated by one of ordinary skill in the art in view of this disclosure.

FIG. 3B shows a portion of the drill bit 300. In the embodiment shown, drill bit 300 comprises a fixed cutter drill bit with a blade 301 that extends from a bit body 390, with a PDC cutter 302 affixed thereto. The drill bit 300 includes a pocket 304 in the blade 301. As can be seen, the pocket 304 is a notched area in an outer surface of the blade 301 in which the PDC cutter 302 is at least partially disposed. The depth, length, and angle of the pocket 304 may be altered according to the configuration of the PDC cutter 302 and the configuration of the cutting structure desired for the drill bit 300. A cutting structure may be configured, for example, to cut more aggressively when the formation is composed of a relatively soft rock. In those instances, the PDC cutter 301 may extend farther from the blade 301, thereby cutting more or the formation. In the embodiment shown, the pocket 304 is angled and the polycrystalline diamond layer 302*a* extends from the blade 301, with the cutting structure of the PDC cutter 302 at a pre-determined angle to the blade 301.

The drill bit 300 may further include an alloy 306 that affixes the PDC cutter 302 to the blade 301. The alloy 306 may be in a gap 307 between the PDC cutter 302 and the blade 301. The gap 307 may vary in size depending on the application, but is typically on the order of about 50 to 300 micrometers. Alloy 306 may comprise a mixture or metallic solid solution composed of two or more metal phases. In certain embodiments, alloy 306 may contain one or more of a solid solution of metal (a single phase); a mixture of metallic phases (two or more solutions); or an intermetallic compound with no distinct boundary between the phases. Typical alloys used to attach PDC cutters to drill bits are referred to as braze alloys that are low-melting point metallic alloys. These alloys suffer from erosion issues, specifically the wearing away of the alloy when the drill bit is deployed downhole and subjected to drilling mud and formation fluids. The strength of the alloys can be increased by altering the elemental composition of the alloy solution, such as changing the metal phases within the alloy, but this typically lowers the melting point of the alloy such that it can melt when subjected to downhole conditions.

According to aspects of the present disclosure, the alloy 306 may include a particulate phase that is added into the metallic phase or phases of the alloy 306. In certain embodiments, the particulate phase may comprise particulates in the form of a fine powder. The particulate phase may comprise, for example, a fine powder of a ceramic or intermetallic material. The ceramic material may comprise an inorganic, nonmetallic solid that prepared by the action of heat and subsequent cooling. The intermetallic material may comprise solid phases containing two or more metallic elements, with optionally one or more non-metallic elements, whose crystal structure differs from that of the other constituents. In certain embodiments, the ceramic material may have a crystalline or partly crystalline structure, or may be amorphous. Example ceramic materials include oxides, such as alumina, beryllia, ceria, zirconia; and nonoxides, such as carbide, boride, nitride, and silicide. Example carbides include tungsten carbide, boron cabide, titanium carbide, etc. In an exemplary embodiment, the particulate phase may comprise tungsten carbide, similar to the tungsten carbide used to for the substrate of the PDC cutter 302.

The size of the particulates within the particulate phase may be based, at least in part, on the size of the gap 307. For example, a maximum size of the particulates within the particulate phase may be based on the size of the gap 307. In certain embodiments, the maximum size of the particulates may be less than the size of the gap 307, so that the gap 307 is not increased by the particulate phase. In certain embodiments, the maximum size of the particulates within the particulate phase may be some multiple less than the size of the gap 307, so that some of the particulates may align within the gap 307 without increasing the size of the gap 307. When the particulates align, it may increase the strength of the bond. In an exemplary embodiment, when the gap 307 is 50 micrometers, the maximum particle size may be set at 10 micrometers, to ensure that the addition of the particulate size does not increase the size of the gap 307. A minimum size for the particles may be selected based on manufacturing or economic constraints. For example, nanoparticles may provide a strong bond, but they may be prohibitively expensive to generate or purchase, and they may pose health risks to workers.

Unlike typical processes, adding a particulate phase into the alloy increases the strength of the alloy without significantly affecting the melting point of the alloy. The increased strength and erosion resistance of the alloy may improve the reliability and performance of drill bits by providing a better bond between the cutting element and the drill bit. The better bond may reduce the number of cutting elements that become detached from the drill bit downhole, which may lead to longer drilling times and better overall drill bit performance.

According to aspects of the present disclosure, manufacturing a reinforced braze alloy may comprise providing at least one of a molten metallic or intermetallic phase of an alloy. The molten metallic or intermetallic phase may be provided by melting a pre-manufactured alloy or through the manufacturing processing of mixing the phases of the alloy. The method may further include dispersing a particulate phase within the at least one molten metallic or intermetallic phase. As described above, a size of the particulates within the particulate phase may be determined based, at least in part, on the size of the gap between a PDC cutter and a blade. The particulate phase may be received at the manufacturing location. In certain embodiments, receiving the particulate phase may comprise one of manufacturing the particulate phase to produce the necessary particle size, or purchasing a particulate phase with particulates of the necessary size.

The concentration of the particulate phase may be selected according to the properties required of the final braze. For example, a higher concentration of the particulate phase would be needed in situations where erosion was a concern, whereas a lower concentration may be if the drill bit may be subject to high impact. The ranges for the concentrations may be determined experimentally, as too little particulate will not improve the braze allow and too much may prevent the a proper bond from forming between the cutter and the bit.

In certain embodiments, dispersing the particulate phase within the at least one molten metallic or intermetallic phase may comprise physically or magnetically agitating the molten metallic or intermetallic phase. Agitating the at least one molten metallic or intermetallic phase may disperse the particulate phase evenly within the metallic or intermetallic phase. For heavier particulates, such as tungsten carbide, the agitation may continue as the molten metallic or intermetallic phase with the particulate phase is extruded for cooling. This may reduce the likelihood that the heavy particulate phase will settle within the molten metallic or intermetallic phase.

According to certain embodiments, a drill bit with a blade, a cutting element, and a particulate reinforced alloy affixing the cutting element to the blade may be included within a drilling assembly similar to the one described in FIG. 1. The drilling assembly may be introduced into a borehole within a subterranean formation, and the drill bit may be rotated. In certain embodiments, the drill bit may be rotated using a top drive positioned at the surface and coupled to a drill string. In certain other embodiments, the drill bit may be rotated by a mud motor disposed within the borehole. Rotating the drill bit may extend the borehole until a target location is reached.

According to certain embodiments, a method for manufacturing a drill bit may include receiving a drill bit body with a blade and receiving a cutting element. The drill bit body and cutting element may be received, for example, if they are manufactured by one or more parties and received by another party. Likewise, the drill bit body and cutting element may be received if they are manufactured separately in one location by one entity and are received at a second location by the same entity. The preceding examples do not cover all potential examples of receiving a drill bit body with a blade and receiving a cutting element. The method may further include affixing the cutting element to the blade with an alloy that contains particulates.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A drill bit for subterranean drilling operations, comprising:

a drill bit body with a blade comprising a pocket;

a cutting element at least partially disposed within the pocket; and an alloy in a gap between the pocket and the cutting element, the alloy affixing the cutting element to the blade in the pocket, the alloy including a particulate phase comprising particulates comprising an amorphous ceramic material.

2. The drill bit of claim 1, wherein the particulates comprise at least one of an additional ceramic material and/or an intermetallic material.

3. The drill bit of claim 1, wherein the ceramic material comprises tungsten carbide.

4. The drill bit of claim 1, wherein the particulates have a size based, at least in part, on the gap between the pocket and the cutting element.

5. The drill bit of claim 1, wherein the drill bit comprises a fixed cutter drill bit.

6. The drill bit of claim 1, wherein the cutting element comprises a polycrystalline diamond compact cutter.

7. The drill bit of claim 1, wherein the ceramic material comprises an oxide, a carbide, a boride, a nitride, or a silicide.

8. The drill bit of claim 7, wherein the oxide comprises alumina, beryllia, ceria, or zirconia.

9. The drill bit of claim 7, wherein the carbide comprises boron carbide or titanium carbide.

10. A method for subterranean drilling, comprising:

introducing a drilling assembly into a borehole within a subterranean formation, wherein the drilling assembly comprises a drill bit; and the drill bit comprises a drill bit body with a blade comprising a pocket;

a cutting element at least partially disposed within the pocket; and an alloy in a gap between the pocket and the cutting element, the alloy affixing the cutting element to the blade in the pocket, the alloy including a particulate phase comprising particulates comprising an amorphous ceramic material; and rotating the drill bit to extend the borehole.

11. The method of claim 10, wherein the particulates comprise at least one of a ceramic material and/or an intermetallic material.

12. The method of claim 10, wherein the ceramic material comprises tungsten carbide.

13. The method of claim 10, wherein the particulates have a size based, at least in part, on the gap between the pocket and the cutting element.

14. The method of claim 10, wherein the drill bit comprises a fixed cutter drill bit.

15. The method of claim 10, wherein the cutting element comprises a polycrystalline diamond compact cutter.

16. The method of claim 10, wherein the ceramic material comprises an oxide, a carbide, a boride, a nitride, or a silicide.

17. The method of claim 16, wherein the oxide comprises alumina, beryllia, ceria, or zirconia.

18. The method of claim 16, wherein the carbide comprises boron carbide or titanium carbide.

* * * * *